US005921833A

United States Patent [19]

Bixby

[11] Patent Number: 5,921,833

[45] Date of Patent: Jul. 13, 1999

[54] OSCILLATING SURFBOARD STRINGER

[76] Inventor: John A. Bixby, 510 Nautilus St., La Jolla, Calif. 92037

[21] Appl. No.: 09/166,515

[22] Filed: Oct. 5, 1998

Related U.S. Application Data

[63] Continuation-in-part of application No. 08/584,607, Jan. 11, 1996, Pat. No. 5,816,875.

[51] Int. Cl.[6] ..... B63B 35/79

[52] U.S. Cl. ..... 441/74; 114/125

[58] Field of Search ..... 441/65, 74, 79; 114/121, 124, 125

[56] References Cited

U.S. PATENT DOCUMENTS

| | | | |
|---|---|---|---|
| 3,254,622 | 6/1966 | Bramson | 441/74 |
| 4,867,721 | 9/1989 | Fisher | 114/125 |
| 4,904,215 | 2/1990 | Sherwood | 441/79 |

*Primary Examiner*—Ed L. Swinehart
*Attorney, Agent, or Firm*—Frank G. Morkunas

[57] ABSTRACT

An improved stringer for a recreational board such as a water board or similar riding structure. The stringer has a center panel with side surfaces and at least one longitudinal cavity within its center panel. A hollow member is positioned within the longitudinal cavity. The hollow member has at least two ends and is closed at these ends. Within the hollow member is a fluid substance which is less in volume than a total volume of the hollow member which thereby permits the fluid substance to move back and forth within the hollow member which, by such movement, facilitates momentum, acceleration, leverage, and drive. The center panel may have one or more such cavities and fluid-filled hollow member. Depending on desired performance, these cavities with their fluid-filled hollow members may also be positioned adjacent to the sides of the center panel.

20 Claims, 1 Drawing Sheet

OSCILLATING SURFBOARD STRINGER

CROSS REFERENCE AND RELATED INVENTIONS

This application is a continuation-in-part application of my U.S. patent application, for which I am the sole inventor, application Ser. No. 08/584,607, filed on Jan. 11, 1996, now U.S. Pat. No. 5,816,875. I am the sole inventor of the improvements and embodiments contained herein.

STATEMENT REGARDING FEDERALLY-SPONSORED RESEARCH OR DEVELOPMENTS

Not applicable.

BACKGROUND OF INVENTION

This invention relates to surfboard construction, specifically stringer construction that will enhance board riding performance.

Previously in surfboard construction, the stringer has taken a back seat in construction and design evolution. In the last few decades the stringer has experienced limited manipulation by shapers strictly for the purpose of shaping a surfboard. Its expanded purpose, as set forth in my co-pending application and the present invention, has been overlooked by industry manufacturers. Till this date the sole purpose of the stringer was to provide structure and strength. These purposes are typical in all surfboards manufactured today.

Foam sheets or panels (often referred to as 'blanks') form the bulk of a surfboard. The common method of manufacturing shapeable blanks generally is by gluing the panels to wood centerlines (or "stringers" as they are referred to in the industry). Another method of construction utilizes a three-part panel (a right-side panel, a center panel, and a left-side panel) with two stringers in between each adjoining panel. The center panel is a type of stringer generally referred to as the T-band. These methods are simple and the purpose is basic, yet crudely efficient. However, the stringer and T-Band are generally unevolved with regard to the potentially revolutionary advantages they offer after modification.

Because of this neglect in the field as it relates to stringers and the T-Band, no prior art is detectable to match the motion of evolution that the co-pending invention and the present invention create. Instead the stringer and T-Band have maintained a stagnate stable purpose until the advent of my inventions. The innovation of my co-pending invention and the present invention has incorporated the realms of kinesthetic dynamics and fluid motion into stringer and T-Band construction, structure, and design. Such structural features will revolutionize avenues for further development in this area and, in particular, to surfboard stringer and T-Band construction. Further they create new realms that will be explored through some basic modifications to stringers and T-Bands that will enhance surfboard riding and potentially effect other similar water craft.

Specifically this high performance stringer and T-Band construction is revolutionary and innovative in purpose, because through a self-contained oscillating structure in the stringer and the T-Band, it generates momentum. Generation of such momentum through water, for example, equates to favorable byproducts in surfing such as projection, acceleration, better leverage for the surfer, greater rail friction, and deeper concentrated drive.

The primary purposes of strength and structure associated with current stringers and T-Bands are still preserved while a multitude of dynamic forces are introduced to what were previously stable and stagnant pieces of equipment. Through the self-contained momentum potential in the stringer and the T-Band, this product will take performance and invention to new levels. Never before has stringer and T-Band construction been explored in this capacity. More accurately surfboard invention has never been explored in this realm. Construction and design innovation have always come from the exterior most commonly in curvature, length, edges, and exterior attachments. Never before has surfboard invention made attempts at innovation through the capacity for energy, directly within the stringer, the T-Band, and the surfboard, that is creatively harnessed by the present invention.

Accordingly, several objects and advantages of the present invention include:

a. applicability to shortboard, longboard, and big wave surfboards; available and corresponding to invention specifications;

b. incorporating the manipulable realms of momentum, projection, and acceleration;

c. providing the primary purposes of strengthening and structure;

d. expanding on primary needs by concealing a self contained apparatus which generates momentum and accents the kinesthetic dynamics involved in surfboard riding;

e. accenting the kinesthetic dynamics natural to surfboard riding;

f. enhancing weight distribution by-products including drive, trim, and unweighting;

g. enhancing trim (lateral movement) through weight distribution;

h. providing greater depth and rail commitment when fluid has concentrated at the tail in the shaft of the stringer;

i. providing acceleration and projection when stringer shaft fluid transfers weight to the nose;

j. incorporating realms of fluid dynamics, weight distribution, inertia, and kinesthetic dynamics, all become manipulable, applicable concepts for surfboard riding and invention exploration; and k. transferring focus to the core of surfboards to explore physical dynamics, as opposed to typical exterior structural modifications.

The foregoing has outlined some of the more pertinent objects of the present invention. Further objects and advantages of my invention will become apparent from a consideration of the drawings and ensuing description. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF INVENTION

An improved stringer for a recreational board such as a water board. The stringer has a center panel with side surfaces and at least one longitudinal cavity within the center panel. A hollow member is positioned within the longitudinal cavity. The hollow member has at least two ends and is closed at these ends. Within the hollow member is a fluid substance which is less in volume than a total volume of the hollow member which thereby permits the fluid substance to move back and forth within the hollow member which, by such movement, facilitates momentum, acceleration, leverage, and drive. The center panel may have one or more such cavities and fluid-filled hollow member. Depending on desired performance, these cavities with their fluid-filled hollow members may also be positioned adjacent to the sides of the center panel.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

DETAILED DESCRIPTION OF THE INVENTION

Figure 1:
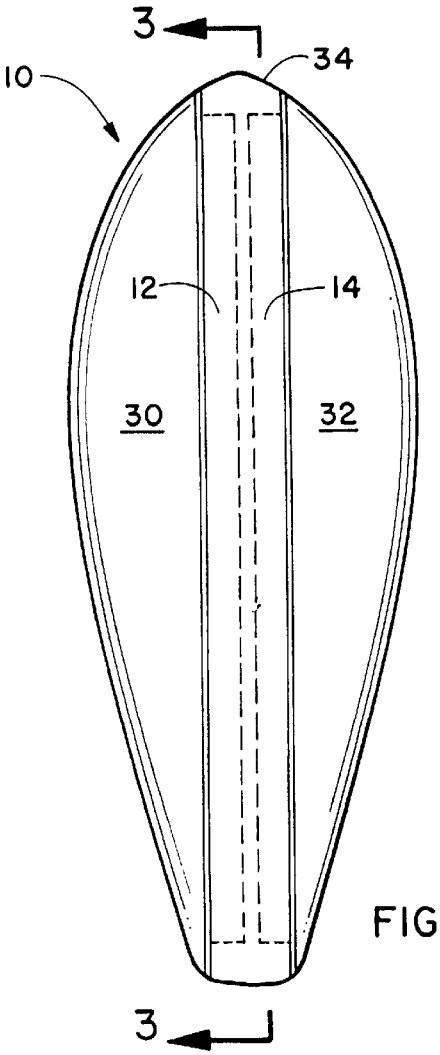
FIG. 1 is a plan view of a T-Band constructed surfboard.

Referring now to the drawings in detail and in particular to FIG. 1, reference character 10 generally designates a surfboard constructed with the T-Band center panel 34. This type surfboard entails one side panel 30, affixed to one stringer 20, and another side panel 32, affixed to another stringer 22. The two stringers in turn are affixed to the T-Band 34. Gluing is the most common method of affixing the panels 30, 32, 34 and stringers 20, 22 to one another, though any method suitable for the intended purpose will suffice.

The wood stringers 20, 22 may be cut from and desired and suitable material to include the length, generally from nose to tail, of the finished product. Thickness and width are also taken into account and gauged by the needs of the shaper and/or the end-user or other performance-related specifications. Widths of between ⅛ inch up to 2 inches or more may be utilized. Invention specification and desired affect also determines how much curve or rocker is cut. This procedure is basic and universal. Use of two side panels 30, 32, a T-Band 34, and two stringers 20, 22 is not uncommon in surfboard construction of this type.

Figure 2:
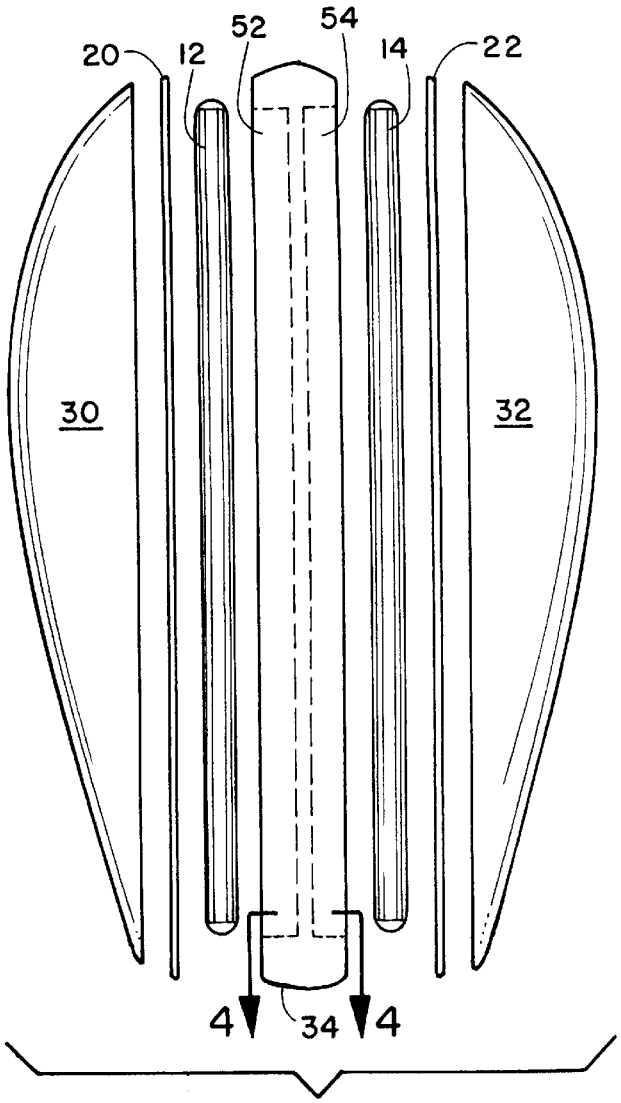
FIG. 2 is an exploded view of the surfboard illustrated in FIG. 1.

What is unique in the present invention is the incorporation of one or more fluid shafts into the T-Band 34 adjacent to a stringer 20, 22. In the embodiment illustrated in FIG. 1, two such shafts 12, 14 (or hollow members) are illustrated in phantom lines. FIG. 2 illustrates the structure in greater detail with attention being invited to the T-Band 34. Illustrated in phantom line inlaid within the T-Band 34, and running from approximately nose to tail of the surfboard 10, are two cavities 52, 54. Shafts 12, 14, respectively, insert into cavities 52, 54. The length of the shafts in relation of the overall length of the surfboard (nose to tail) may range between 50% to 99% of the length of the surfboard. Better riding results occur with a shaft length of between 60% to 90% of the length of the surfboard. Even better results, however, have been achieved with a shaft length of approximately 80% of the length of the surfboard.

Maintaining the shafts 12, 14 in place within the T-Band 34 are stringers 20, 22 on either side of the T-Band 34. The surfboard 10 is completed by affixing the two side panels 30, 32 to the respective stringers 20, 22.

Figure 3:
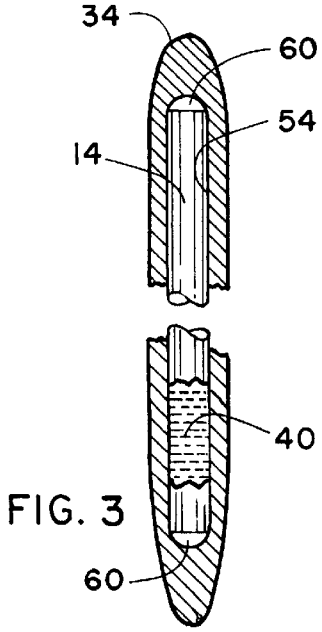
FIG. 3, taken on line 3—3 of FIG. 1, is a cross-section side view on the interior structure of the T-Band.

FIG. 3 illustrates the structure of the shafts 12, 14 (using shaft 14 as the example for discussion purposes only) which is similar to the shaft disclosed in my above-referenced co-pending application. The shaft used for the present invention may be any hollow member or container suited for the intended purpose and may be constructed of plastic or graphite and may be rigid or flexible. The interior of the hollow member may range in thickness or diameter between about ½ inch to about one or more inches. Better results have been achieved using hollow member having an interior diameter or thickness of approximately ¾ inch. The diameter or thickness can range with the thickness of the surfboard. The shaft structure is capped or closed at both ends with caps or stops 60 suitable for the intended purpose.

The shaft 14 houses a liquid or fluid element or substance 40 which, for good riding results, could encompass between about 10% to about 90% of the total internal volume capacity of the shaft interior. The fluid element 40 is sealed and maintained inside the shaft by caps 60. Better riding results have been achieved with a fluid content of between about 25% to 75% of the total internal volume capacity of the shaft interior. Even better results, however, have been achieved with a fluid content of approximately 50% of the total internal volume capacity of the shaft.

Figure 4:
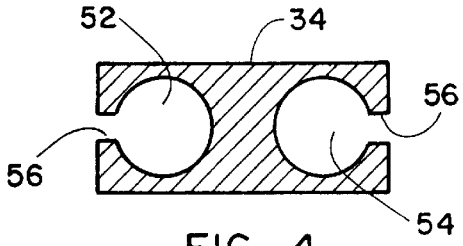
FIG. 4, taken on line 4—4 of FIG. 2, is a cross-section view of the interior structure of the T-Band.

FIG. 4 illustrates the interior structure of a T-Band 34 adapted to accommodate two shafts. As shown here strictly by way of example only, not by way of limitation, one cavity 52 is structured to house one shaft 12 whereas another cavity 54 is structured to house another shaft 14. Shafts are generally insertable into their respective cavities 52, 54 through the slots 56 on the outer surface of the T-Band 34, though any means of insertion may be utilized. For example, the nose end or the tail end of the T-Band 34 may be cut, suitably hollowed to form one or more cavities, one or more shafts inserted into the one or more cavities, and the cut end or ends reattached thereby eliminating the slot structure 56.

Figure 5:
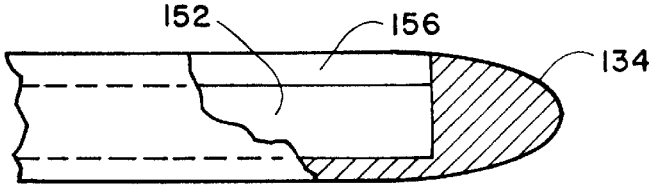
FIG. 5 is a partial, cut-away, plan view of a second embodiment of the T-Band.

FIG. 5 illustrates a T-Band 134 structured to house a single shaft in cavity 152. The shaft also may be insertable into this T-Band 134 through the slot 156 or by way of cutting either the nose end or tail end, forming a cavity therein, inserting a shaft, and reattaching a cut end, as described above. The present invention contemplates one or more shafts constructed within a T-Band 34, or one or more shafts 12, 14 constructed within the side panels 30, 32. The construction and design are limited only by a crafter's intended and desired performance from the finished product.

In use with surfboards, the present invention becomes manipulable upon attainment of the finished product. When a shaped (foam) surfboard blank or panel is fiberglassed and prepared for riding, it is then the full interactive experience begins to operate.

Beneath the glass shell, within the T-Band 34 or either side panel 30, 32 lies one or more shafts 12, 14. Inside the T-Band 34 or side panels 30, 32, as the case may be, is where the manipulable realms of kinesthetic dynamics originate. At this origin the board rider can manipulate the dynamic range of internal motion available from the housed fluid 40. The internal motion of the fluid is what creates the energy potential translating to physical displays of momentum, acceleration, projection, and enhanced depth and drive.

In surfboard riding, use of the present invention will require no specific adjustments to manipulate its functions. However, the subtleties of its manipulable range deserve exploration to fully maximize its broad range of application.

Namely, the oscillation of fluid 40 within the shaft 12 creates the effect of an internal wave enhancing the actual wave being ridden. This is largely due to the weight distribution factors. In an acceleration mode, when the fluid has rushed to the nose of the board, and body weight is stable on the tail, concentration of friction is along the rail (outer edge) of the board connected to the face of the wave. This is commonly referred to as "on edge". Being on edge is magnified by the weight distribution at opposite ends. The sensation of the physical dynamics is similar to the release of a swinging pendulum.

This sensation is a highly favorable accent to some specific positions in wave riding. For example in a big wave riding, when paddling into a big wave the lift begins to put the rider in a near vertical position at the top of the wave. The rider stands up toward the tail of the board as the vertical wall shapes and gravity pulls the rider down the face of the wave. At this time the majority of connection is at the inside rail. The vertical position and downhill slope of the wave create enough angle for gravity to work inside the shaft 12, 14 (within the stringer 20, 22; within the T-Band 34; or within either side panel 30, 32) at which time the fluid rushes to the nose of the board. This boost is fully engaged at the bottom of the wave when the rider begins to make the turn to outrun the avalanche of water. This momentum created off the drop accented by the inertia within the board gives a deeper rail commitment through the bottom turn. As the tail unweights after the turn momentum has translated to another favorable byproduct that hurls the rider further out to the safe flats. This dynamic translation of energy from the bottom of the wave is referred to as projection.

Another specific example of the applicability to the high performance associated with this stringer/T-Band construction in wave riding is demonstrated through a common position experienced in longboard surfing.

When surfing smaller waves that break laterally to the shore, many surfers choose to ride a wide, full model often referred to as a longboard. When a surfer is gliding laterally to a shoreline across the face of the wave a maneuver known as "a stall" is often executed. A stall is the surfers attempt at burying the tail to slow the speed of the board, create rail and tail depth, and often provides the rider an opportunity to reposition their body to conform to the breaking part of the wave. The stall is an attempt to allow the breaking part of the wave time to catch up. Often the stall is used as a manner to set up for what is known as a tube ride. The slowing down, and burying of the rail allows the throwing portion of the wave to cover the rider completely in a spinning water cylinder. Depth is always desirable in this lodged position. A rapid exit to the shoulder of a wave is the safest way out of a closing tube.

The present invention comes to play quite efficiently for this matter; namely stalling and the tube ride. The desirable dynamics are relatively the same in both positions. The fluid element 40 in the shaft 12 exhibits the same patterns in both maneuvers. When the rider buries the tail while using the present invention, they create a fluid rush to the tail of the board. The concentrated weight at the tail enhances its depth. This not only deepens the tail rail in the face of the wave but also has the potential to help the rider get back further in the tube with a more committed position. Generally riders work for deep tube rides.

The most valuable tool for getting out of a deep stall or fade in the tube is ability to accelerate. Often times surfers don't make deep tube rides contrary to their desire. They get engulfed by the white wash due to lack of rail commitment (loss of friction) or inability to smoothly accelerate. The use of fluid-oriented shafts 12 (inlaid within stringers 20, 22; T-Bands 34; and/or side panels 30, 32) solves both of these problems.

Considering that a buried tail rail slows the board and rear shaft fluid 40 enhances depth, acceleration is imperative. The modified stringer 20, 22 or T-Band 34 or side panels 30, 32, or any combination thereof, becomes a valuable tool when acceleration maneuvering is required. As discussed in the first part of this section, fluid flow to the nose generates momentum. In lateral surfing, flow from the tail to the nose subtly creates the leverage needed to maximize rail connection. The combination of a connected tail rail and increasing weight in the nose (unweighted tail) blends the friction necessary for smooth down the line speed, hence acceleration.

In retrospect, the cited positions typically displayed in surfing provide excellent examples for the range of constructive fluid flow that the proposed stringer integrates with board riding. Consequently, a surfboard 10 constructed with fluid-oriented shafts within stringers 20, 22, and/or T-Bands 34, and/or side panels 30, 32, as described herein provides an evolved stringer 20, 22, T-Band 34, and side panel 30, 32 application never before attempted, and accords a tremendous range of manipulable dynamic potential through fluid flow. Moreover, the primary purpose of strength and structure stay intact.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. For example, the shaft or shafts can have a variety of shapes, gauges, lengths, or volume variations. They may be configured parallel with the stringer or perpendicular to it. The fluid within the shaft may also be accented or replaced by one or more solid moving structures. The shaft also need not be within a closed system, but rather may be user-accessible. Accordingly, the scope of the invention should be determined not by the embodiment[s] illustrated, but by the appended claims and their legal equivalents.

What I claim is:

1. In a water board having a stringer, an improved stringer comprising:

a. a center panel having side surfaces and at least one longitudinal cavity within said center panel;

b. a hollow member within said at least one longitudinal cavity, said hollow member having at least two ends and being closed at said ends; and c. a fluid substance within said hollow member, said fluid substance being less in volume than a total volume of said hollow member, thereby permitting said fluid substance to move back and forth within said hollow member.

2. The invention as defined in claim 1 wherein said hollow member within said center panel comprises a length which is approximately between 50% to 99% of the total length of the water board.

3. The invention as defined in claim 1 wherein said hollow member within said center panel comprises a length which is approximately between 60% to 90% of the total length of the water board.

4. The invention as defined in claim 1 wherein said hollow member within said center panel comprises a length which is approximately 80% of the total length of the water board.

5. The invention as defined in claim 1 wherein a volume of said fluid substance comprises approximately between 10% to 90% of a total volume of said hollow member.

6. The invention as defined in claim 1 wherein a volume of said fluid substance comprises approximately between 25% to 75% of a total volume of said hollow member.

7. The invention as defined in claim 1 wherein a volume of said fluid substance comprises approximately 50% of a total volume of said hollow member.

8. In a water board having a stringer, an improved stringer comprising:

a. a center panel having side surfaces;

b. a first stringer adjacent to one side of said center panel and a second stringer adjacent to another side of said center panel;

c. at least one longitudinal cavity adjacent to at least one side surface;

d. a hollow member within said at least one longitudinal cavity, said hollow member having at least two ends and being closed at said ends; and e. a fluid substance within said hollow member, said fluid substance being less in volume than a total volume of said hollow member, thereby permitting said fluid substance to move back and forth within said hollow member.

9. The invention as defined in claim 8 wherein said hollow member within said at least one longitudinal cavity comprises a length which is approximately between 50% to 99% of the total length of the water board.

10. The invention as defined in claim 8 wherein said hollow member within said at least one longitudinal cavity comprises a length which is approximately between 60% to 90% of the total length of the water board.

11. The invention as defined in claim 8 wherein said hollow member within said at least one longitudinal cavity comprises a length which is approximately 80% of the total length of the water board.

12. The invention as defined in claim 8 wherein a volume of said fluid substance comprises approximately between 10% to 90% of a total volume of said hollow member.

13. The invention as defined in claim 8 wherein a volume of said fluid substance comprises approximately between 25% to 75% of a total volume of said hollow member.

14. The invention as defined in claim 8 wherein a volume of said fluid substance comprises approximately 50% of a total volume of said hollow member.

15. The invention as defined in claim 8 wherein said first stringer and said second stringer comprise a width of approximately between ⅛ inch to 2 inches.

16. An improved water board having a stringer, said water board comprising:

a. a first panel and a second panel;

b. a center panel in between said first panel and said second panel, said center panel having side surfaces;

c. a first stringer and a second stringer on each said surface of said center panel;

d. at least one longitudinal cavity adjacent to at least one side surface;

e. a hollow member within said at least one longitudinal cavity, said hollow member having at least two ends and being closed at said ends;

f. a fluid substance within said hollow member, said fluid substance being less in volume than a total volume of said hollow member, thereby permitting said fluid substance to move back and forth within said hollow member.

17. The invention as defined in claim 16 wherein said at least one longitudinal cavity is positioned within any one of said panels.

18. The invention as defined in claim 16 wherein a volume of said fluid substance comprises approximately between 10% to 90% of a total volume of said hollow member.

19. The invention as defined in claim 16 wherein said hollow member within said at least one longitudinal cavity comprises a length which is approximately between 50% to 99% of the total length of the water board.

20. The invention as defined in claim 16 wherein said first stringer and said second stringer comprise a width of approximately between ⅛ inch to 2 inches.

* * * * *